US007841755B1

(12) United States Patent
Walker

(10) Patent No.: US 7,841,755 B1
(45) Date of Patent: Nov. 30, 2010

(54) LUMINAIRE AND MOUNTING BRACKET COMBINATION

(75) Inventor: Justin M. Walker, York, PA (US)

(73) Assignee: Genlyte Thomas Group LLC, Louisville, KY (US)

( * ) Notice: Subject to any disclaimer, the term of this patent is extended or adjusted under 35 U.S.C. 154(b) by 98 days.

(21) Appl. No.: 12/115,012

(22) Filed: May 5, 2008

(51) Int. Cl.
*F21S 8/00* (2006.01)

(52) U.S. Cl. ..... 362/432; 362/147

(58) Field of Classification Search ..... 362/147, 362/432

See application file for complete search history.

(56) References Cited

U.S. PATENT DOCUMENTS

| | | | |
|---|---|---|---|
| 1,388,221 | A | 8/1921 | Toepfer |
| 1,539,131 | A | 5/1925 | McCarley |
| 1,633,837 | A | 6/1927 | Youtz |
| 2,166,394 | A | 7/1939 | Crossley |
| 2,288,166 | A | 6/1942 | Kucher |
| 2,313,131 | A | 3/1943 | Elias |
| 2,545,163 | A | 3/1951 | Naster |
| 2,687,867 | A | 8/1954 | Wolar |
| 2,852,663 | A | 9/1958 | Stuffer et al. |
| 2,960,361 | A | 11/1960 | Boutelle |
| 2,971,737 | A | 2/1961 | Parker |
| 2,973,895 | A | 3/1961 | Brown et al. |
| 3,078,366 | A | 2/1963 | Winkler |
| 3,082,987 | A | 3/1963 | Robinson |
| 3,154,704 | A | 10/1964 | Shaffer |
| 3,299,200 | A | 1/1967 | Sulzer |
| 3,299,265 | A | 1/1967 | Rackley et al. |
| 3,319,203 | A | 5/1967 | Haughney |
| 3,388,246 | A | 6/1968 | Bailey |
| 3,433,449 | A | 3/1969 | Musante |
| 3,479,081 | A | 11/1969 | Schaaf |
| 3,505,515 | A | 4/1970 | Adra |
| 3,541,478 | A | 11/1970 | Peterson et al. |
| 3,604,916 | A | 9/1971 | Adra et al. |
| 3,754,724 | A | 8/1973 | Osowski |
| 3,778,610 | A | 12/1973 | Wolf |
| 3,852,588 | A | 12/1974 | Grawford |
| 3,991,905 | A | 11/1976 | Nicpon |
| 4,000,406 | A | 12/1976 | Bhavsar |
| 4,090,210 | A | 5/1978 | Wehling et al. |
| 4,112,483 | A | 9/1978 | Small, Jr. et al. |
| 4,143,413 | A | 3/1979 | Kelly |
| 4,173,037 | A | 10/1979 | Henderson, Jr. et al. |
| 4,212,050 | A | 7/1980 | Trenkler |
| 4,217,629 | A | 8/1980 | Russell |
| 4,254,456 | A | 3/1981 | Grindle et al. |
| 4,310,876 | A | 1/1982 | Small, Jr. et al. |
| 4,317,164 | A | 2/1982 | Karaktin |
| 4,319,313 | A | 3/1982 | Eberhart et al. |

(Continued)

*Primary Examiner*—David V Bruce

(57) ABSTRACT

A luminaire and mounting bracket combination is disclosed which allows the luminaire to be readily installed and retained by the bracket while the installer permanently affixes the luminaire directly to the bracket. Single installer capability is therefore allowed due to the construction of the support bracket and luminaire combination described. The bracket incorporates the use of a plurality of support arms and possibly a lower support bracket which correspondingly fit into apertures formed in the luminaire support frame formed on the mounting face of the luminaire. The design allows the luminaire to be vertically lowered on the support bracket and retained thereby while the installer fastens the luminaire directly to the bracket without need for additional support mechanism or aid.

7 Claims, 5 Drawing Sheets

U.S. PATENT DOCUMENTS 4,333,131 A 6/1982 Hujimoto et al.
4,337,507 A 6/1982 Lasker
4,403,278 A 9/1983 Flood
4,414,616 A 11/1983 de Vos et al.
4,422,135 A 12/1983 McCamy
4,449,168 A 5/1984 Ewing
4,459,648 A 7/1984 Ullman
4,460,948 A 7/1984 Malola
4,473,873 A 9/1984 Quiogue
4,527,224 A 7/1985 Sangiamo et al.
4,590,544 A 5/1986 Decandia
4,623,956 A 11/1986 Conti
4,709,890 A 12/1987 Moore
4,760,511 A 7/1988 Russello et al.
4,794,501 A 12/1988 Bartenbach
4,893,224 A 1/1990 Tinley
4,970,634 A 11/1990 Howell et al.
5,016,150 A 5/1991 Gordin et al.
5,068,769 A 11/1991 Umeda et al.
5,111,371 A 5/1992 Nielson
5,136,493 A 8/1992 Straus
5,249,110 A 9/1993 Russello et al.
5,307,254 A 4/1994 Russello et al.
5,309,334 A 5/1994 Willison
5,323,995 A 6/1994 Grittman et al.
5,339,234 A 8/1994 Russello et al.
5,442,132 A 8/1995 Sandell et al.
5,613,766 A 3/1997 Raouf
5,642,934 A 7/1997 Haddad
5,647,659 A 7/1997 Mori
5,690,419 A 11/1997 Siems
5,704,710 A 1/1998 Greene et al.
5,722,770 A 3/1998 Douglas
5,803,585 A 9/1998 Littman et al.
5,906,431 A 5/1999 Chianale et al.
6,059,424 A 5/2000 Kotloff
6,116,564 A 9/2000 Cates
6,290,376 B1 9/2001 Gutierrez et al.
6,375,141 B1 4/2002 Kettlestrings
6,467,928 B2 10/2002 Crelin
6,517,216 B1 2/2003 Cercone et al.
6,530,681 B2 3/2003 Sieczkowski
6,607,292 B2 8/2003 Gutierrez et al.
6,733,158 B2 5/2004 Fisher et al.
6,848,806 B2 2/2005 Yoshida et al.
6,848,813 B2 2/2005 Patz
6,905,222 B1 6/2005 Russello et al.
7,090,382 B2 8/2006 Haddad et al.
7,108,238 B2 9/2006 Gauci
7,121,684 B2 10/2006 Barozzini et al.
7,150,542 B1 12/2006 Russello et al.
7,325,938 B2 2/2008 Yoshida et al.
7,360,929 B2 * 4/2008 Pfund et al. ..... 362/368
7,455,428 B1 11/2008 Russello
2004/0095773 A1 5/2004 Gaskins
2009/0034242 A1 * 2/2009 Engel ..... 362/368

* cited by examiner

LUMINAIRE AND MOUNTING BRACKET COMBINATION

BACKGROUND OF THE INVENTION

1. Field of the Invention

This invention relates to surface mount luminaires, and, more particularly, to a mounting bracket and luminaire combination providing for efficient mounting of the luminaire to a surface.

2. Description of Related Art

Surface mount luminaires are mounted to provide general lighting of indoor and outdoor spaces. It should be understood that the description of the luminaires as "surface mount" type luminaires is intended to distinguish the luminaires from "recessed" type luminaires. Thus, the invention taught herein will apply to all "surface mount" type luminaires, including, but not limited to, arm mounted luminaires mounted directly to a wall.

Luminaires are often installed in locations that are only accessible by a ladder and which only permit a single person to install the luminaire. Additionally, many luminaires require an installer to position a luminaire on a mounting bracket with one hand while attempting to install fasteners with the other hand. There exists a need for increased ease and safety for the installation of luminaires.

SUMMARY OF THE INVENTION

In accordance with the present invention there is provided a luminaire and bracket combination which allows the luminaire housing to be quickly and easily mounted to a pole or to a bracket. The bracket has a mounting surface with at least one pair of horizontally aligned upwardly opening substantially parallel hooks. The bracket also has a lower hook opening upwardly between and below the at least one pair of horizontally aligned hooks. Above the horizontally aligned upwardly opening hooks is an outwardly extending flange above and between the horizontally aligned hooks. The flange has an aperture for receiving a fastener therethrough.

A corresponding luminaire has a rear mounting portion suitable for hanging and installing on the bracket. The mounting portion of the luminaire has at least one pair of vertically oriented mating slots suitable for receiving each of the horizontally aligned upwardly opening hooks on the bracket. Between the vertically oriented slots is a slot central therewith having a portion above the vertically oriented parallel slots. The mounting portion of the luminaire also has a threaded cylindrical opening suitably oriented to receive a fastener extending through the aperture in the flange extending from the bracket. The luminaire is mounted to a surface by first fastening the bracket to the surface and then placing the slots in the luminaire mounting portion about the upwardly opening parallel hooks and flange. The luminaire is then lowered so that the upwardly opening parallel hooks and lower hook of the bracket receive a portion of the mounting portion of the luminaire above the slots. A fastener is then placed through the aperture in the flange and is fasteningly engaged with the threaded cylindrical opening in the mounting portion of the luminaire.

The bracket and luminaire combination provides a mechanism and method for quick and easy attachment and securement of the luminaire into the attachment bracket which may be installed on a vertical install surface or other support structure such as a pole for single person installation. The design also allows for permanent mechanical attachment joining the housing to the bracket.

BRIEF DESCRIPTION OF THE DRAWING FIGURES

Figure 3A:
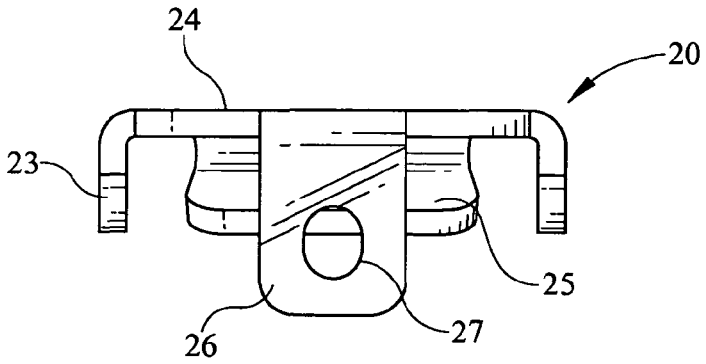
Figure 3B:
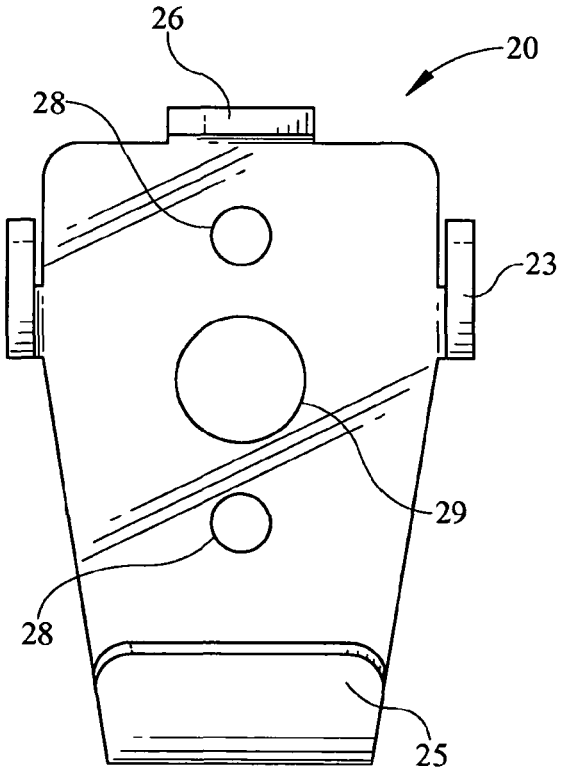
Figure 3C:
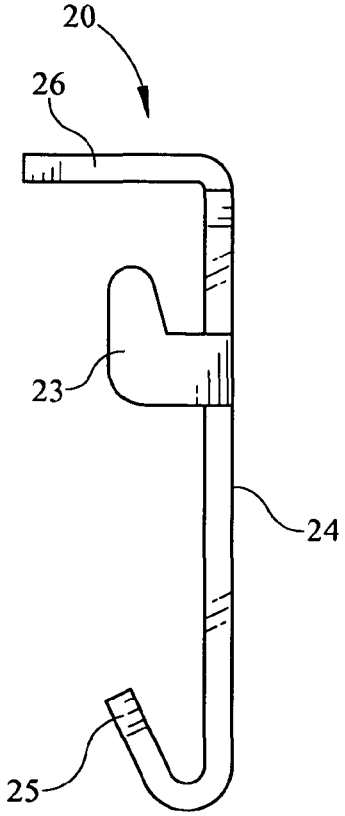
Figure 4A:
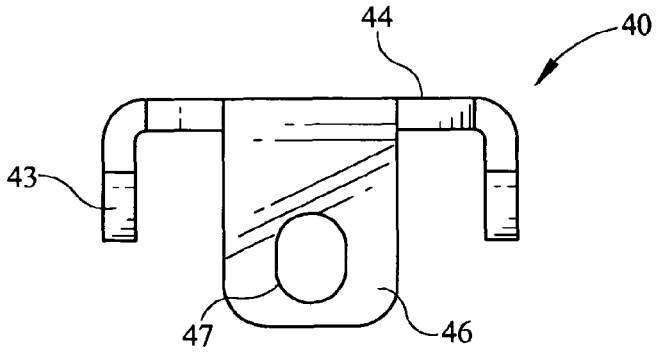
Figure 4B:
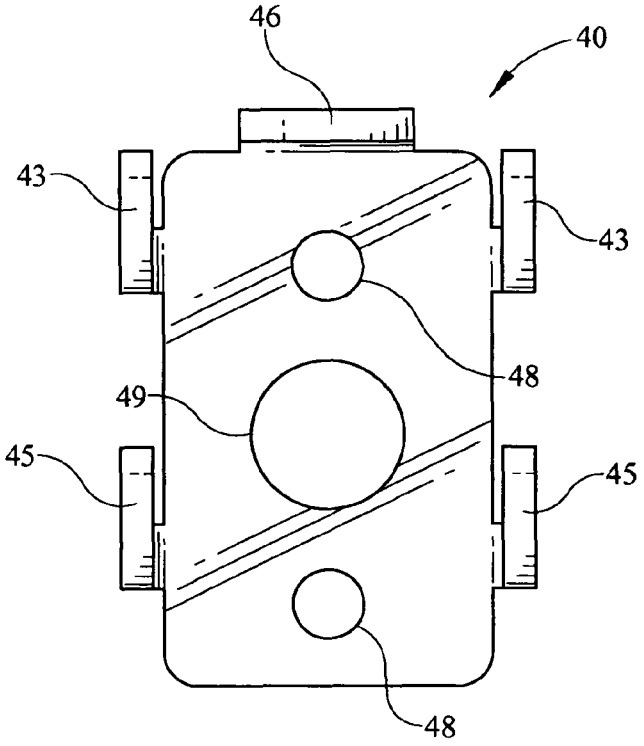
Figure 4C:
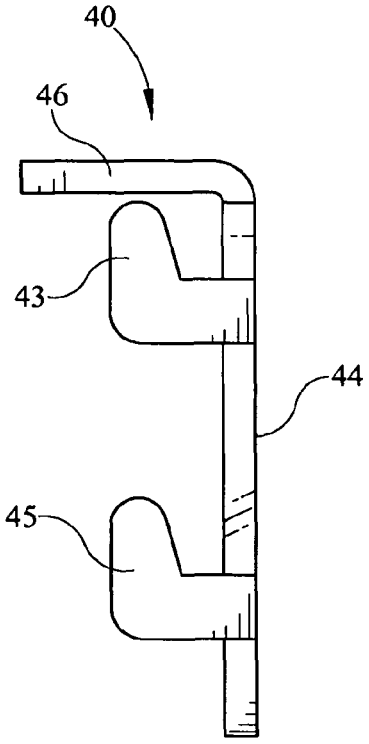
Figure 5:
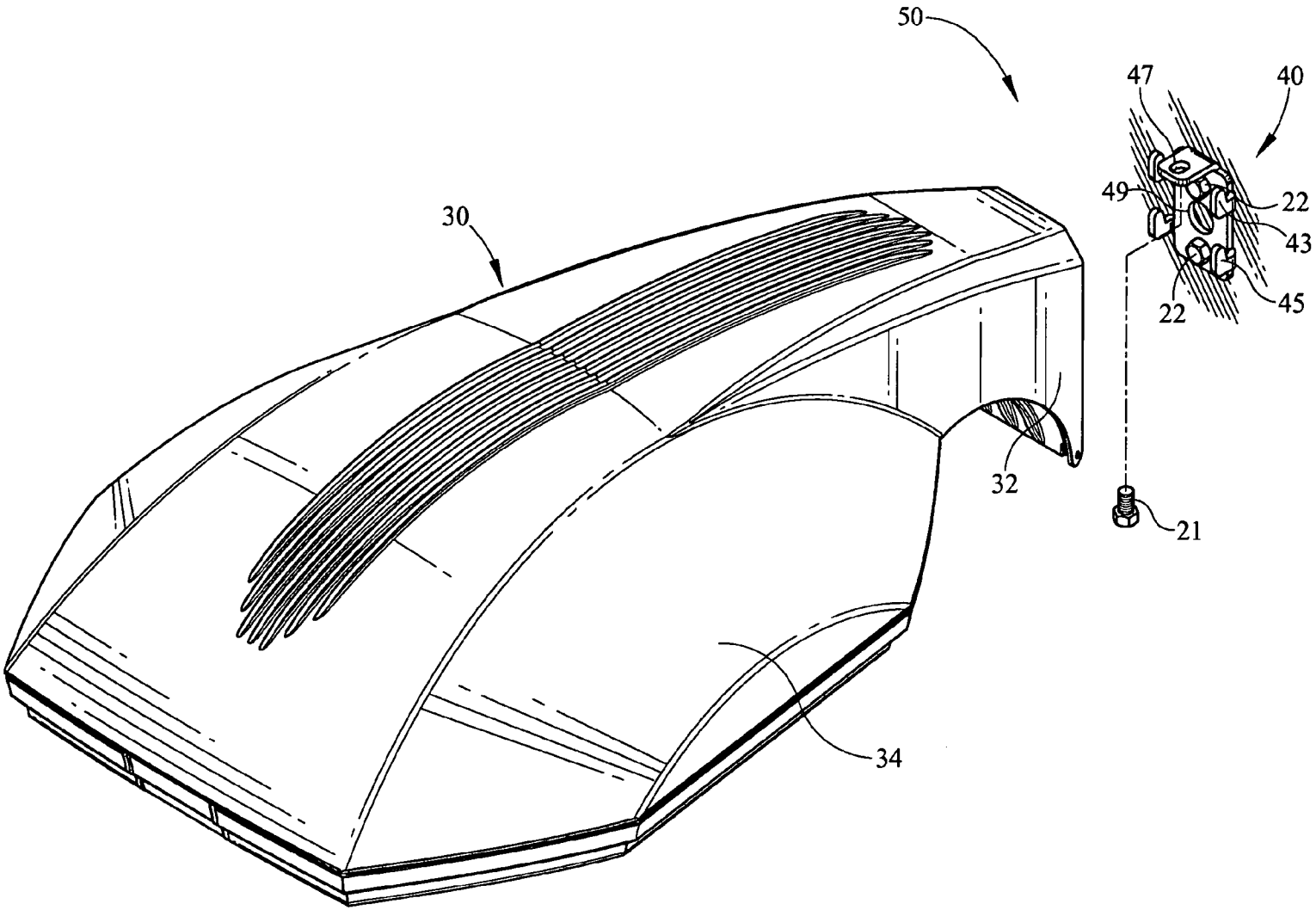

FIGS. 3*a*, 3*b* and 3*c* are variant views of the mounting bracket of the present combination detailing the various features thereof;

FIGS. 4*a*, 4*b* and 4*c* detail the mounting bracket of an alternative construction for the mounting bracket and luminaire combination described herein;

FIG. 5 is a disassembled view of the luminaire and mounting bracket combination described herein with the mounting bracket shown in FIGS. 4*a*, 4*b* and 4*c*.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Figure 1:
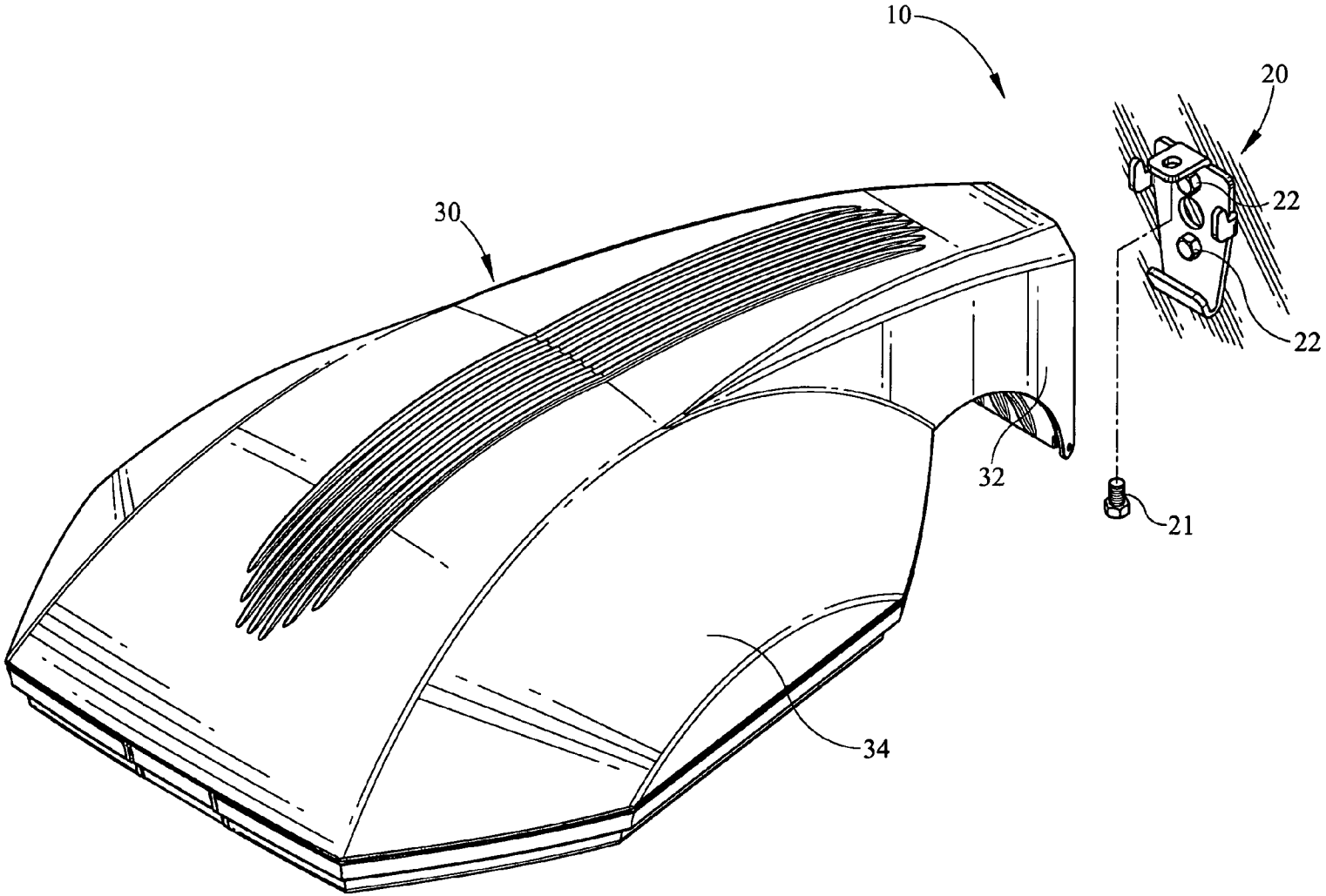
FIG. 1 is a perspective view of a luminaire and mounting bracket combination showing a mounting bracket mounted on a surface and a luminaire removed therefrom.

As shown in the figures is the luminaire mounting bracket combination for relatively easy installation of a luminaire on a surface mount type installation. As shown in FIG. 1, the luminaire 30 consists of the body or frame element 34 with an extending support arm 32. As may be readily understood however, many variations to luminaire construction and designs may be used in combination with the luminaire mounting support and bracket disclosed herein and the various embodiments shown in the figures are just one implementation incorporating the aspects of the luminaire mounting bracket combination described. Returning to the figures, the luminaire body and frame 34 has a support arm extending rearwardly towards a support surface. As depicted in FIG. 1, the support surface has mounted thereto a support bracket 20, the support bracket 20 showing dual support fasteners or hooks 23 or multiple hooks 43, 45 as shown. The overall design and construction of the luminaire and mounting bracket combination of the various embodiments allows the luminaire to be installed on typical surface mount installations and may be placed and thereby hands free supported upon the support bracket 20 while fastening of the luminaire to the support bracket may be implemented through the use of fastener 21 and the like. Through implementation of the combination of luminaire and mounting bracket shown herein, the luminaire may be securely positioned on the mounting bracket and then, subsequent to support of the luminaire by the mounting bracket, firm fixation of the luminaire to the mounting bracket may be accomplished without the need for additional installers to maintain the position of the luminaire relative to the support bracket while securing the luminaire to the support.

As may be interpreted from FIG. 1, installation of the luminaire 30 of the present invention may incorporate separate attachment of the support bracket 20 directly to the support surface without the necessity of similarly attaching the luminaire directly to the support surface. Depicted in both FIG. 1 and FIG. 5, the support bracket 20, 40 may be utilized to support the luminaire directly to the vertical install surface by first attaching the support bracket 20, 40 directly to the installation surface and then allowing the bracket 20, 40 to support the luminaire 30 in place while the luminaire is maintained securely in position and aligning the necessary aperture or other bracket securement structure with corresponding structure on the luminaire. In both embodiments, the luminaire is securely affixed and held in place against the support bracket 20, 40 without the ability to be rotated, moved or the luminaire light redirected unless the entire luminaire is lifted off of the support arms 23, 43, 45, depicted in the various embodiments. Utilizing the various embodiments depicted in the figures, once the luminaire 30 is positioned against the support bracket 20, 40, by virtue of the design of the support bracket, support arms 23, 43 and 45 and bracket support 25, the luminaire may not be moved unless raised off of the support bracket 40, 20 as shown in the various embodiments and is maintained in aligned position for permanent affixation to the support bracket.

Figure 2:
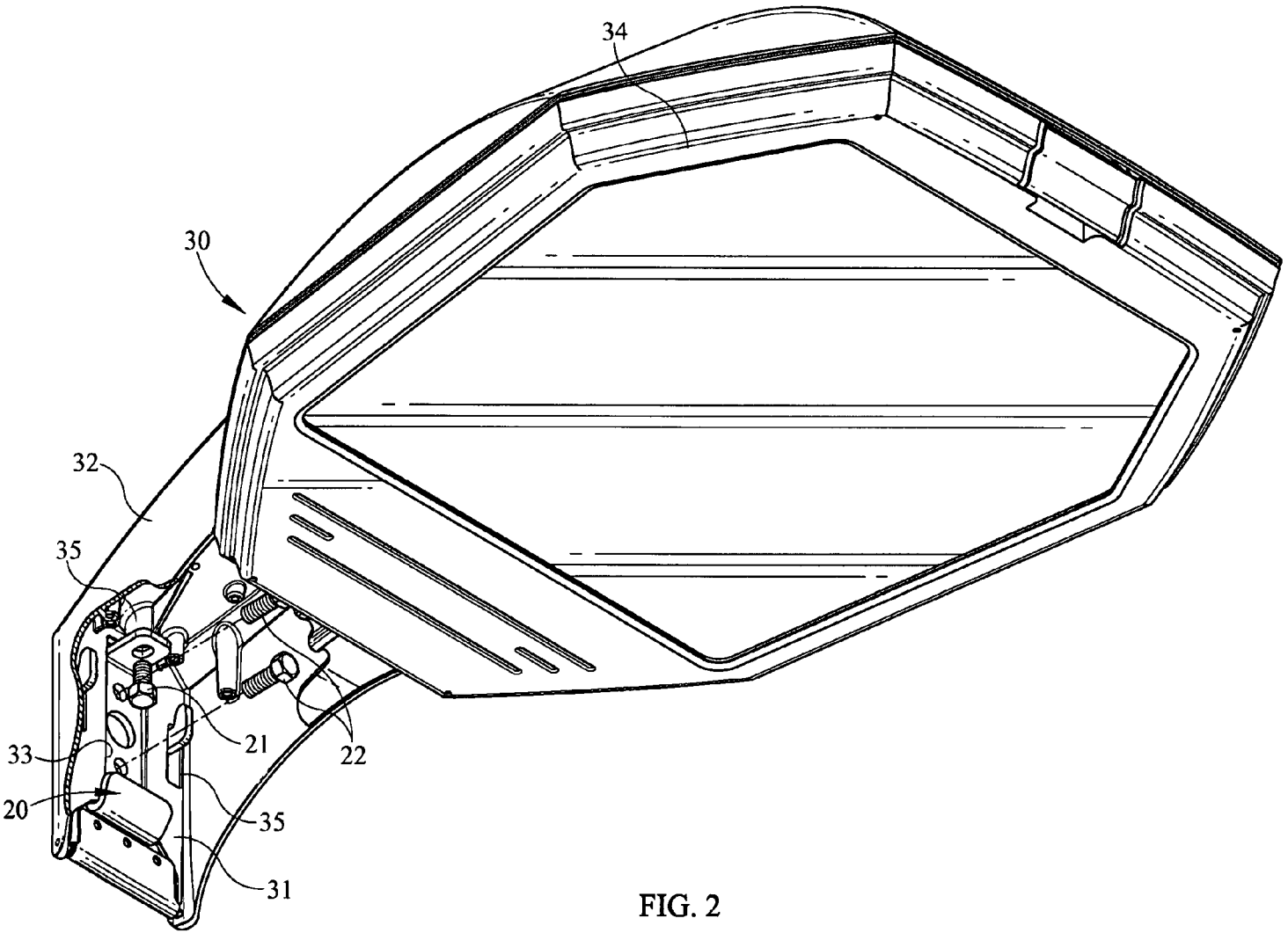
FIG. 2 is a lower perspective view of the luminaire and mounting bracket combination detailing the support arm and bracket assembly from a sectional view thereof.

Turning to FIG. 2, installation of the luminaire and bracket support assembly is more clearly shown in the cutaway of the support arm 32. As depicted, the luminaire 30 is directly and physically attached to the mounting bracket 20 or, similarly the mounting bracket 40 depicted. As shown, the luminaire 30 is securely affixed to the mounting bracket 20 and may thereafter be non-removably affixed by securing fastener 21 directly to fastener mount 35 formed within luminaire support arm 32. Fastener 21 securely affixes the luminaire 30 to the mounting bracket 20 but allows the luminaire 30 to be removed therefrom for servicing, replacement or other necessary maintenance. The design set forth allows quick initial installation by a single installer while preventing the need of a second installer to hold the fixture in place. The fixture housing may be lifted in place on the bracket and wedged in place on angled finger bracket hooks. A captive bolt on the bracket is tightened into the housing and the remaining components of the fixture such as the ballast tray, lens, frame, bulb, etc. may be installed into the housing to complete installation. Direct access to the interior attachment surface structure of the luminaire support arm 32 may be had by known structure such as having a removable face plate, hinged face plate or other similar structure on the lower surface or alternative areas thereof.

As is depicted in FIG. 2, the luminaire 30 may not be pulled away from the wall due to the various structures formed on the support bracket 20. As may be seen, support bracket 20 has multiple structures which retain the luminaire 30 in place against the wall and therefore against the bracket. As is shown, the mounting bracket 20 has a bracket support or lower hook member 25, shown in FIGS. 3*a*, 3*b* and 3*c* which work in conjunction with the various support arms or hook structures 23. As may be readily understood, due to the upwardly directed formation of these structures formed on the support bracket 20, once installed and resting within place on the structures, the luminaire 30 may not be pulled directly away from the wall and support bracket combination. Additionally, the weight of the luminaire therefore further acts to secure the luminaire 30 in place against these support arms 23 and bracket support 25 to prevent the luminaire from becoming dislodged prior to fastener 21 being affixed to fastener mount 35 through fastener arm 26 outwardly extending from bracket 20. As can be seen, fastener arm 26 has aperture 27 through which the fastener 21 extends in order to be retained by fastener mount 35 on luminaire support arm 32.

Various structures may be formed on the support bracket 20 depicted in the multiple embodiments including the mounting apertures 28 which receive the fasteners 22 shown in the figures. Further, wiring aperture 29 may be placed within the support wall and mounting surface 24 in order to allow wiring extending from the support surface through the mounting bracket 20 and into the support arm 32 of the luminaire 30 for electrically connecting the luminaire to an electrical power source.

The rear mounting face or luminaire support frame 31 of the support arm end of the luminaire 30 may have a plurality of vertically extending slots for capturing the correspondingly positioned support arms or hooks 23 depicted in FIGS. 3*a*, 3*b* and 3*c*. Additionally, the mounting face may have on the lower portion thereof a support frame structure for contacting of the lower hook or support bracket 25 as is shown as well as a vertically extending aperture 33 in order that the wiring and other connections may be fed through the wiring aperture 29 into the interior of the luminaire support arm 32.

As may be readily understood from the various drawings and from the cutaway of FIG. 2, once installed, the support bracket 20 may be utilized to firmly retain the luminaire 30 in place while securely affixing the luminaire to the support bracket. Once installed, the support bracket 20 has exposed upwardly extending bracket support 25 which has a slight outward and upward curvature thereto in the present embodiment, although other structures are equally as viable, as well as upwardly extending support arms or hooks 23. Thus, the support bracket has two points of contact and support at a minimum at various points including an axis defined by the dual support arms 23 in combination with a secondary axis defined by the bracket support 25 below the support arms 23. For installation purposes, the support bracket 20 may be installed against the vertical support surface and securely affixed thereto through the utilization of the fasteners 22. Once positioned against the support surface, upwardly extending support arms 23 and bracket support 25 are exposed and may receive various portions of the mounting face and support frame 31 of the luminaire 30. In the present embodiment, the upwardly extending support arms 23 may extend through the mating slots 35 formed on the support frame and mounting face 31 of the rear support and surface of the support arm 32. Additionally, the lower portion of the support frame 31 may be slid downward into the gap formed by the upward and outward flange of the bracket support 25 to slidingly receive and support the luminaire 30. Due to the upwardly extending structure and definition of the hooks and support arms 23, once the luminaire is lowered into place, the luminaire support frame 31 rests between the bracket support 25 and the mount surface 24. Additionally, the upwardly extending hooks 23 retain additional surfaces of the luminaire support frame 31 such that there are multiple points of contact between the support bracket and the support frame.

Once the luminaire 30 is lowered so that it is retained within the three points of contact identified, the luminaire may be securely affixed to the support bracket 20 through the utilization of fastener 21 extending upward and through fastener mount 35. As is depicted, a threaded bolt or other securement device may be utilized to secure the luminaire support arm and luminaire directly to the mounting bracket 20 thereby preventing removal from the mounting bracket without unthreading or removal of the various fasteners which may be utilized and which are known.

By providing multiple points of contact between the mounting face 31 of the luminaire support arm 32 and the support bracket 20, the luminaire 30 remains securely fastened to the support bracket 20 without the need of removable fasteners and the like to retain position between the luminaire and the support bracket during final installation. While the luminaire is retained readily through the multiple points of contact between the mounting surface of the support arm and the upwardly extending surfaces or support members of the support bracket, further securement may take place without the necessity of supporting the luminaire in position.

Alternative constructions for the support bracket and luminaire support frame 31 may be implemented. As shown in FIGS. 4*a*, 4*b* and 4*c*, alternative structures from the bracket support 25 or lower hook may be implemented. Similar multiple points of contact may be maintained through the various embodiments depicted and known as a result of the teachings hereof including the depiction of the support bracket 40 shown in FIGS. 4*a*, 4*b* and 4*c*. In this embodiment, multiple hooks or support arms 43 and 45 may be shown wherein each of the support arms are positioned and have mating or co-aligned apertures formed in the support frame of the rear face of the support arm 32 from the luminaire 30. Thus, multiple slots or openings may be correspondingly formed matching the position of the plurality of support arms 43, 45 formed on the bracket 40 in order to provide multiple points of contact between the bracket and the luminaire. In the design set forth, the plurality of hooks have upwardly extending portions as previously described which will retain the luminaire in proper position once lowered onto the support bracket and plurality of bracket support arms and members. Once retained thereby, the outwardly extending flange 46, similar to the flange or fastener arm 26 of the alternative embodiments, may be utilized to secure the luminaire directly to the bracket through the utilization of a similar fastener 21 to extend through the fastener arm aperture 47 and into a fastener mount 35.

Turning to the embodiment utilizing the support brackets 40 shown in FIGS. 4*a*, 4*b* and 4*c* is depicted in FIG. 5, the bracket has a plurality of support arms 43, 45 as are shown. In the embodiment of the support bracket 40 depicted, with utilization of the lower support arms 45 there is no need to include the bracket support 25 implemented in FIGS. 3*a*, 3*b* and 3*c*. Lower support arms 45 work in conjunction with upper support arms 43 to adequately and fully support the luminaire 30 on the support bracket 40 against the vertical mounting surface. Similarly, aperture 47 is provided in order to adequately retain the luminaire 30 onto the bracket 40 once the luminaire is lowered and the support arms 43, 45 retain the mounting face of the rear portion of the luminaire. Similarly, wiring aperture 49 is available for use in order to feed electrical wiring into the support arm 32 such that the power supply may be properly wired. Corresponding plurality of slots are similarly provided on the rear surface of the luminaire support frame 31 similar to as is shown in FIG. 2 such that sufficient vertical length is provided for proper positioning of the luminaire downward and retention by the support arms against the support frame.

The foregoing description of structure and methods has been presented for purposes of illustration. It is not intended to be exhaustive or to limit the invention to the precise steps and are forms disclosed and many modifications and variations are possible in light of the teachings incorporated herein and set forth both within the specification and the figures. It is understood that while certain forms of the luminaire and mounting bracket combination have been illustrated and described in the multiple embodiments, it is not limited thereto except in so far as such limitations are included in the following claims in allowable functional equivalents thereof.

I claim:

1. A luminaire and mounting bracket combination comprising:

a mounting bracket having a substantially flat mounting surface with at least one pair of substantially horizontally aligned upwardly opening hooks;

said mounting bracket having a lower supporting hook extending upwardly between and below said at least one pair of substantially horizontally aligned upwardly opening hooks;

said mounting bracket having an outwardly extending flange above and between said at least one pair of substantially horizontally aligned upwardly opening hooks, said flange having an aperture therein;

a luminaire having a mounting face with at least one pair of vertically oriented slots suitable for receiving said at least one pair of substantially horizontally aligned upwardly opening hooks on said bracket:

said mounting face of said luminaire having a centrally oriented opening suitable for receiving said outwardly extending flange on said bracket;

said mounting face of said luminaire having a support luminaire frame below said centrally oriented opening suitable for resting within said lower hook on said mounting bracket; and said mounting face of said luminaire further having fastener mount suitably oriented for fasteningly receiving a fastener extending through said aperture in said outwardly extending flange of said bracket.

2. The luminaire and mounting bracket combination of claim 1 wherein said fastener mount in said mounting face of said luminaire is a threaded cylindrical opening.

3. The luminaire and mounting bracket combination of claim 1 wherein said mounting bracket has at least two pair of substantially horizontally aligned upwardly opening hooks.

4. The luminaire and mounting bracket combination of claim 3 wherein each of said at least two pair of substantially horizontally aligned upwardly opening hooks are substantially vertically aligned.

5. A luminaire and bracket combination for easy installation of the luminaire onto a support structure, comprising:

a support bracket securely affixed to a support structure and having an upper support structure and a lower support structure, both said upper and lower support structure extending outwardly from a mounting surface on said bracket, both said lower and upper support structure having upwardly extending portions for capturing and retaining a luminaire support frame, said mounting surface further having a wiring aperture allowing wiring to extend through said aperture into said luminaire;

wherein said luminaire has said luminaire support frame, said luminaire support frame has corresponding surfaces for mating with said upper and lower support structure on said support bracket;

wherein said support bracket further has an outwardly extending fastener arm with an aperture formed therein, said aperture of said fastener arm coaligned with a securing fastener mount on said luminaire allowing a fastener mechanism to extend through said fastener arm of said mounting bracket and into said fastener mount on said luminaire.

6. A method for mounting a luminaire comprising:

fastening a bracket to a mounting surface, said bracket having at least one pair of horizontally aligned upwardly opening parallel hooks, a lower upward opening hook between and below said at least one pair of horizontally aligned hooks and a flange having an aperture extending outwardly above and between said horizontally aligned hooks;

placing vertically oriented slots in a luminaire mounting portion about said upwardly opening parallel hooks;

lowering said luminaire onto said upwardly opening parallel hooks wherein said upwardly opening parallel hooks and said lower hook of said bracket each receive a portion of said mounting portion of said luminaire; and fastening said flange to said mounting portion of said luminaire.

7. A luminaire and mounting bracket combination, comprising:

a mounting bracket affixable to a vertical surface and having a first and a second luminaire supporting structure, said first luminaire supporting structure including at least one pair of upwardly extending opening support hooks aligned to be received with an opening on a support base of said luminaire, said mounting bracket further having below said first luminaire supporting structure said second luminaire supporting structure, said first and said second luminaire supporting structure working in unison to support said luminaire, said second luminaire supporting structure engaging said luminaire support base;

wherein said bracket supports said luminaire through said first luminaire supporting structure and said second luminaire supporting structure in position for subsequent positive affixation of said luminaire bracket to said luminaire, said positive affixation of said luminaire to said mounting bracket including secure affixation of a fastener arm on said bracket directly to a fastener arm receiving structure on said luminaire.

* * * * *